US010610028B2

(12) United States Patent
Sherman et al.

(10) Patent No.: US 10,610,028 B2
(45) Date of Patent: Apr. 7, 2020

(54) MATTRESS WITH MICROCOIL CELLS

(71) Applicants: Philip R. Sherman, Melville, NY (US); Philip W. McCarty, Natick, MA (US)

(72) Inventors: Philip R. Sherman, Melville, NY (US); Philip W. McCarty, Natick, MA (US)

(73) Assignee: PPJ, LLC, Natick, MA (US)

( * ) Notice: Subject to any disclaimer, the term of this patent is extended or adjusted under 35 U.S.C. 154(b) by 301 days.

(21) Appl. No.: 15/137,232

(22) Filed: Apr. 25, 2016

(65) Prior Publication Data

US 2017/0303696 A1 Oct. 26, 2017

(51) Int. Cl.

| | |
|---|---|
| ***A47C 27/06*** | (2006.01) |
| ***A47C 27/20*** | (2006.01) |
| ***A47C 17/00*** | (2006.01) |
| ***A47C 27/04*** | (2006.01) |
| ***A47C 23/04*** | (2006.01) |
| ***A47C 27/15*** | (2006.01) |

(52) U.S. Cl.

CPC ..... *A47C 27/064* (2013.01); *A47C 17/00* (2013.01); *A47C 23/04* (2013.01); *A47C 27/04* (2013.01); *A47C 27/15* (2013.01); *A47C 27/20* (2013.01)

(58) Field of Classification Search

CPC ..... A47C 27/05; A47C 27/056; A47C 27/06; A47C 27/063; A47C 27/064; A47C 27/14; A47C 27/142; A47C 27/144; A61B 6/0428; A61B 6/107; A61B 6/4441; A61M 5/52

See application file for complete search history.

(56) References Cited

U.S. PATENT DOCUMENTS

| | | | | |
|---|---|---|---|---|
| 3,145,020 | A * | 8/1964 | Calla | A47C 27/20 267/143 |
| 3,251,078 | A * | 5/1966 | Calla | A47C 27/064 267/143 |
| 5,222,264 | A * | 6/1993 | Morry | A47C 27/063 267/81 |
| 5,317,768 | A * | 6/1994 | Klancnik | A47C 27/002 5/716 |
| 6,122,787 | A * | 9/2000 | Kao | A47C 27/05 5/720 |
| 6,212,720 | B1 * | 4/2001 | Antinori | A47C 27/086 5/716 |
| 6,353,952 | B1 * | 3/2002 | Wells | A47C 27/062 5/716 |

(Continued)

*Primary Examiner* — Eric J Kurilla
*Assistant Examiner* — Rahib T Zaman
(74) *Attorney, Agent, or Firm* — Patent Portfolio Builders PLLC

(57) ABSTRACT

A mattress includes a top face, a bottom face, a pair of opposing sides defining a mattress width there between, a first microcoil support foam layer and a second microcoil support foam layer. The first microcoil support foam layer includes a plurality of first pockets and a plurality of first protrusions, and the second microcoil support foam layer includes a plurality of second pockets and a plurality of second protrusions. A plurality of separate microcoil cells are formed as lines of microcoils having a width of a single microcoil and a length containing sufficient number of microcoils such that the line of microcoils spans the mattress width. Each one of the microcoil cells is disposed between a given second protrusion and first pocket or a given first protrusion and second pocket.

20 Claims, 12 Drawing Sheets

(56) References Cited

U.S. PATENT DOCUMENTS

| | | | | |
|---|---|---|---|---|
| 6,813,791 | B2 * | 11/2004 | Mossbeck | A47C 27/064 5/716 |
| 6,826,796 | B1 * | 12/2004 | Mossbeck | A47C 23/0433 5/655.8 |
| 6,966,091 | B2 * | 11/2005 | Barber | A47C 27/062 267/89 |
| 8,613,120 | B2 * | 12/2013 | Hawkins | A47C 27/144 5/655.9 |
| 2004/0172765 | A1 * | 9/2004 | England | A47C 27/05 5/716 |
| 2005/0257323 | A1 * | 11/2005 | Edling | A47C 27/062 5/720 |
| 2012/0246833 | A1 * | 10/2012 | Kluft | A47C 23/30 5/717 |
| 2014/0208521 | A1 * | 7/2014 | Farnham | A47C 27/144 5/724 |

* cited by examiner

500

MATTRESS WITH MICROCOIL CELLS

TECHNICAL FIELD

Embodiments of the subject matter disclosed herein relate to mattresses containing innersprings.

BACKGROUND

While mattresses can be constructed from a single layer of cotton or foam rubber or from a unitary block of springs covered in a padding material, improved comfort is achieved through the use of multiple layers. The properties and location of each layer within the mattress are selected to provide a desired level of comfort. Two common layers are foam layers and innerspring layers. Multiple foam layers can be used, with each foam layer having a desired density or firmness. An innerspring is provided as a single layer of multiple springs that are located within the mattress, typically sandwiched between layers of foam, that span substantially the entire width and length of the mattress. These innersprings can be contained within a unitary innerspring frame or placed in a plurality of separate spring fabric pockets. Therefore, the entire body of the user is supported by the innerspring layer.

Conventional innersprings are relatively large in diameter and height, have lower spring counts, i.e., total number of springs in the inner spring layers, and are constructed from wire having a gauge below 13. These conventional innersprings yield a relatively low level of comfort and support as a result of their size, stiffness and number. An attempt at improving the innerspring layer replaces the conventional innersprings with smaller innersprings. Each one of these smaller innersprings is referred to as a "microcoil". A microcoil has a smaller diameter and height and is constructed from thinner and more flexible wire having a gauge above 14. The smaller size of the coils facilitates an increased number of coils in the innerspring coil layer. For example, a microcoil layer can contain 800 or more microcoils. Microcoil inner springs can be used in combination with a conventional innerspring as an additional comfort layer disposed between the conventional innerspring layer and the top surface or sleeping surface of the mattress. This comfort layer increases the comfort and pressure relieving qualities of the mattress.

The single layer of microcoils provides only a limited improvement to the mattress. In addition, the unitary layer of microcoils may not be optimal for adjustable bed applications. Therefore, arrangements of innerspring microcoils are desired that provide improved comfort and that work well with adjustable and articulating bed frames.

SUMMARY

Embodiments are directed to mattresses that utilize arrangements of small springs or microcoils in combination with arrangements of layers of interacting, sculpted foam to enhance the response, comfort, flexibility, contour-ability and support of a mattress or seat construction. Any size mattress can be used including twin, full, queen and king sized mattresses and mattresses for use with adjustable or articulating bed foundations. The microcoils are not provided as a single continuous layer within the mattress. The microcoils are provided in a plurality of independent microcoil cells, and each microcoil cell includes at least two contiguous microcoils, for example, arranged in a line, strip or grid. Multiple microcoil cells can be positioned at different depths and positions in the mattress. This includes being positioned between adjacent layers of foam within the mattress. In one embodiment, these adjacent foam layers do not include a standard flat or planar interface. Instead, the layers contain pockets and protrusions or are otherwise sculpted. The microcoil cells are positioned in the pockets or disposed between a pocket and a mating protrusion. Therefore, the microcoils and foam layers provide a shock absorbing function for pressure relief as well as body contouring flexibility.

Exemplary embodiments are directed to a mattress having a top face, a bottom face opposite the top face and a plurality of separate microcoil cells disposed between the top face and the bottom face. Each microcoil cell includes at least two contiguous microcoils. In one embodiment, each microcoil has a diameter of less than about 1.25 inches and a height of less than about 1 inch. In one embodiment, each microcoil cell includes an identical number and arrangement of microcoils. The plurality of microcoil cells includes a first group of microcoil cells and a second group of microcoil cells. The first group of microcoil cells includes at least one microcoil cell, and each microcoil cell in the first group of microcoil cells is disposed a first distance from the top face. The second group of microcoil cells includes at least one microcoil cell, and each microcoil cell in the second group of microcoil cells is disposed a second distance from the top face. The first distance is different than the second distance. In one embodiment, the plurality of microcoil cells includes a plurality of groups of microcoil cells. Each group of microcoil cells contains at least one microcoil cell, and each microcoil cell in a given group of microcoil cells is disposed a unique distance from the top face. This unique distance is associated with that given group of microcoil cells.

In one embodiment, each microcoil cell is a line of microcoils having a width containing a single microcoil and a length containing a plurality of microcoils. In one embodiment, the mattress includes a pair of opposing sides defining a mattress width there between, and the length of the line of microcoils contains a sufficient number of microcoils such that the line of microcoils spans the mattress width. In one embodiment, the plurality of microcoil cells includes a plurality of parallel lines of microcoils, and the mattress further has a center to center spacing between adjacent parallel lines of microcoils that is greater than a diameter of each microcoil. In one embodiment, the plurality of parallel lines of microcoils includes a first group of parallel lines of microcoils and a second group of parallel lines of microcoils. Each parallel line of microcoils in the first group of parallel lines of microcoils is disposed a first distance from the top face. Each parallel line of microcoils in the second group of parallel lines of microcoils is disposed a second distance from the top face. The first distance is different than the second distance.

In one embodiment, each microcoil cell is a grid of microcoils having at least two microcoils along a width of the grid and at least two microcoils along a length of the grid. In one embodiment, a foam layer is disposed between the top face and the bottom face. This foam layer contains a plurality of pockets, and each one of the plurality of microcoil cells is disposed in one of the plurality of pockets. In one embodiment, the mattress includes a first microcoil support foam layer and a second microcoil support foam layer in contact with the first microcoil support foam layer. The first and second foam layers are disposed between the top face and the bottom face. The first microcoil support foam layer includes a plurality of first pockets and a plurality of first protrusions. The second microcoil support foam layer includes a plurality of second pockets and a plurality of second protrusions. The plurality of second protrusions extends into the plurality of first pockets, and the plurality of first protrusions extends into the plurality of second pockets. Each one of the plurality of microcoil cells is disposed between a given second protrusion and first pocket or a given first protrusion and second pocket. In one embodiment, the mattress includes a pair of opposing sides defining a mattress width there between. Each one of the first and second protrusions is a ridge that spans the mattress width, and each one of the first and second pockets is a trough that spans the mattress width. Each microcoil cell is a line of microcoils having a width with a single microcoil and a length with a plurality of microcoils.

In one embodiment, the mattress includes a foam layer disposed between the top face and the bottom face. This foam layer has a first side containing a plurality of first side pockets and a second side containing a plurality of second side pockets. Each one of the plurality of microcoil cells is disposed in one of the plurality of first side pockets or the plurality of second side pockets. In one embodiment, the mattress includes a pair of opposing sides defining a mattress width there between, and each one of the first side pockets and the second side pockets has a trough that spans the mattress width. Therefore, the foam layer has a corrugated shape. In one embodiment, each microcoil cell is a line of microcoils having a width with a single microcoil and a length with a plurality of microcoils. In one embodiment, a covering foam layer is provided in contact with a first side of the foam layer. The covering foam layer includes a plurality of covering foam layer protrusions extending into the first side pockets. A supporting foam layer is provided in contact with a second side of the foam layer. The supporting foam layer contains a plurality of support foam layer protrusions extending into the second side pockets. Each one of the plurality of microcoil cells is disposed between the plurality of first side pockets and the covering foam layer protrusions or the plurality of second side pockets and the supporting foam layer protrusions.

Exemplary embodiments are also directed to a mattress having a top face, a bottom face opposite the top face, a pair of opposing sides defining a mattress width there between, a first microcoil support foam layer, a second microcoil support foam layer in contact with the first foam layer and a plurality of separate microcoil cells. The first and second microcoil support foam layers are disposed between the top face and the bottom face. The first microcoil support foam layer includes a plurality of first pockets and a plurality of first protrusions. The second microcoil support foam layer includes a plurality of second pockets and a plurality of second protrusions. The plurality of second protrusions extends into the plurality of first pockets, and the plurality of first protrusions extends into the plurality of second pockets. Each one of the first and second protrusions is a ridge that spans the mattress width, and each one of the first and second pockets is a trough that spans the mattress width. Each microcoil cell is a line of microcoils having a width with a single microcoil and a length with a sufficient number of microcoils such that the line of microcoils spans the mattress width. Each one of the microcoil cells is disposed between a given second protrusion and first pocket or a given first protrusion and second pocket.

Exemplary embodiments are also directed to a mattress having a top face, a bottom face opposite the top face, a pair of opposing sides defining a mattress width there between, a foam layer disposed between the top face and the bottom face and a plurality of separate microcoil cells. The foam layer includes a first side having a plurality of first side pockets and a second side having a plurality of second side pockets. Each one of the first side pockets and the second side pockets is a trough that spans the mattress width. Each microcoil cell is a line of microcoils having a width with a single microcoil and a length with a sufficient number of microcoils such that the line of microcoils spans the mattress width. Each one of the plurality of microcoil cells is disposed in one of the plurality of first side pockets or the plurality of second side pockets. In one embodiment, the foam layer has a corrugated shape.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Exemplary embodiments described herein can be used with any suitable size of mattress including twin size, full size, queen size and king size. In addition, exemplary embodiments are suitable for use with adjustable or articulating bed frames. As is understood by one of skill in the art, a mattress includes a top face and a bottom face opposite the top face. The mattress can be single sided, i.e., a user would lie on the top face, or double sided, i.e., the user can lie on either the top face or the bottom face. The mattress is generally rectangular having two opposing ends, e.g., a head end and a foot end, defining a length of the mattress and two opposing sides defining a width of the mattress. The top face and bottom face are spaced from each other by the thickness of the mattress, and the mattress includes edges or edge faces defined by this thickness. The mattress can also include at least one of a split head end and a split foot end that provide for separate articulation of two sides of the mattress at both the head end and foot end. While discussed with respect to a mattress, embodiments can be used in other applications including cushions, upholstery, pillows, air plane seats and automobile seats.

Figure 1:
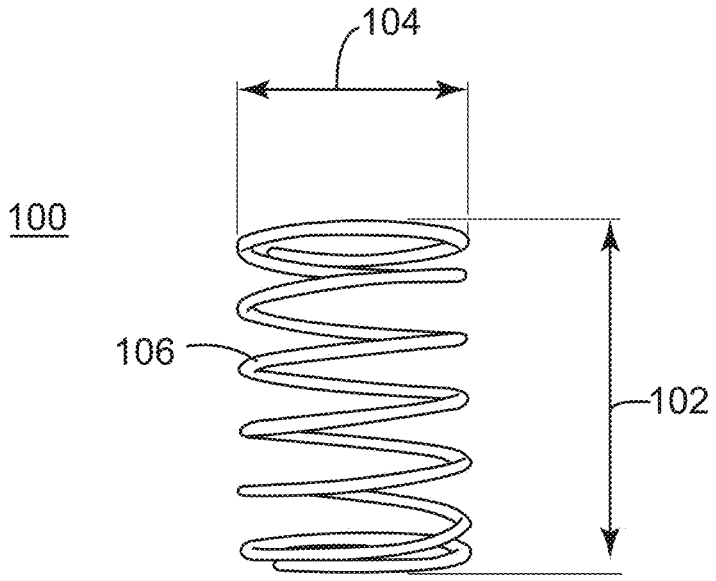
FIG. 1 is a representation of an embodiment of a microcoil for use in embodiments of the mattress.

Referring initially to FIG. 1, exemplary embodiments utilize arrangements of microcoils 100 to achieve improved comfort and performance in a mattress. As used herein, a microcoil is a spring or coil that has a smaller height 102 and diameter 104 than conventional innersprings used in mattresses. Suitable dimensions for each microcoil include, but are not limited to, a diameter of less than about 2 inches (5.1 cm), preferably less than 1.25 inches (3.175 cm) and a height of less than about 1 inch (2.54 cm). In one embodiment, each microcoil has a diameter of about 1.18 inches (3 cm) and a height of about 0.394 inches (1 cm). In addition, the microcoil is constructed from a thinner or more flexible gauge of wire 106. In one embodiment, the gauge of the wire is greater than about 14 gauge (0.641 inches or 1.628 mm). In another embodiment, the gauge of the wire is at least about 19 gauge (0.359 inches or 0.912 mm). In one embodiment, the wire has a diameter of about 0.039 inches (1 mm), and the coil has a diameter of about 1.18 inches (3 cm) and a height of about 0.79 inches (2 cm). In another embodiment, the wire has a diameter of about 0.047 inches (1.2 mm), and the coil has a diameter of about 1.38 inches (3.5 cm) and a height of about 0.79 inches (2 cm). In another embodiment, the wire has a diameter of about 0.047 inches (1.2 mm), and the coil has a diameter of about 1.38 inches (3.5 cm) and a height of about 0.98 inches (2.5 cm). While illustrated as a cylindrical shaped coil with a generally circular cross section, each microcoil can have other shapes including barrel shaped, hour glass shaped or cone shaped and can have other cross-sectional shapes including oblong and rectangular.

Figure 2:
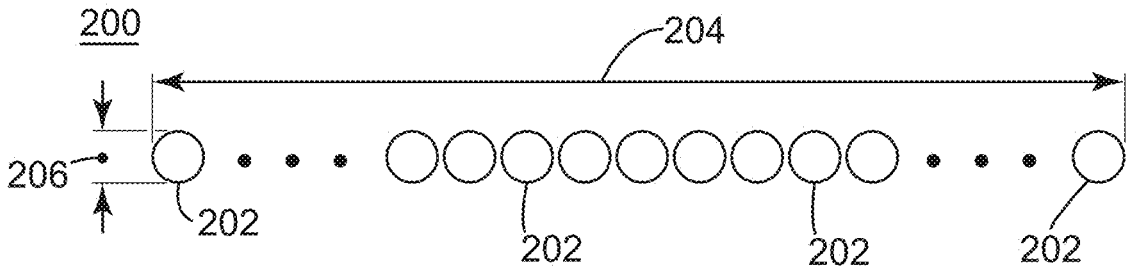
FIG. 2 is a representation of one embodiment of a microcoil cell arranged as a line of microcoils.

Individual microcoils are arranged into microcoil cells. In one embodiment, each microcoil cell includes and equivalent number and arrangement of microcoils. Alternatively, at least one of the number and arrangement of microcoils in two or more microcoil cells varies. Each microcoil cell includes at least two and preferably a plurality of contiguous microcoils. Referring to FIG. 2, in one embodiment, the microcoil cell 200 is arranged as a line or strip containing at least two and preferably a plurality of microcoils 202. In one embodiment, each line of microcoils has a width 206 containing a single microcoil and a length 204 containing at least two and preferably a plurality of individual microcoils. In one embodiment, each line of microcoils includes a sufficient number of microcoils along the length such that the line of microcoils spans the mattress width or mattress length.

Figure 3:
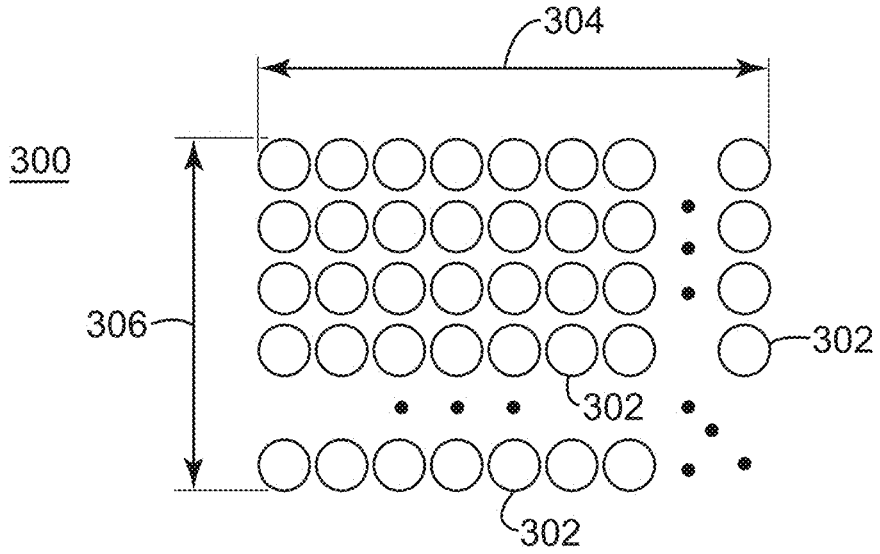
FIG. 3 is a representation of another embodiment of a microcoil cell arranged as a grid of microcoils.

Referring to FIG. 3, in one embodiment, the microcoil cell 300 is arranged as grid containing a plurality of microcoils 302. Each grid of microcoils has at least two microcoils along a width 306 of the grid and at least two microcoils along a length 304 of the grid. The number of microcoils in the length or width is varied to achieve the desired overall shape and to cover the desired area. While illustrated as a line and a grid, each microcoil cell can be arranged in any suitable shape, for example, circular, oblong, triangular and frusto-conical. Microcoil cells can be configured to compliment and to accommodate the shape of a human body or an individual body part.

Figure 4:
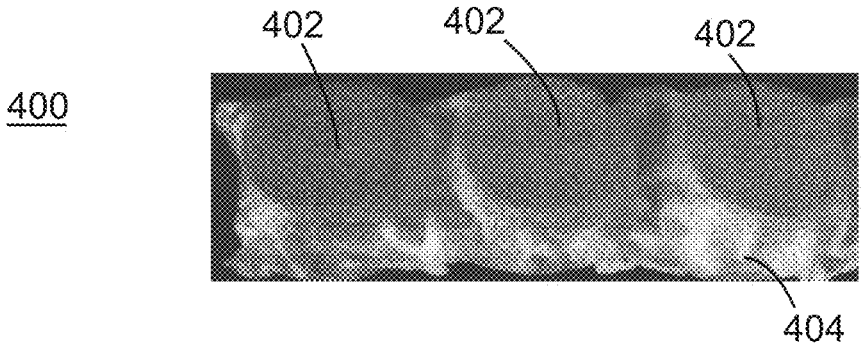
FIG. 4 is a view of an embodiment of a microcoil cell with pocketed microcoils for use in embodiments of the mattress.
Figure 5:
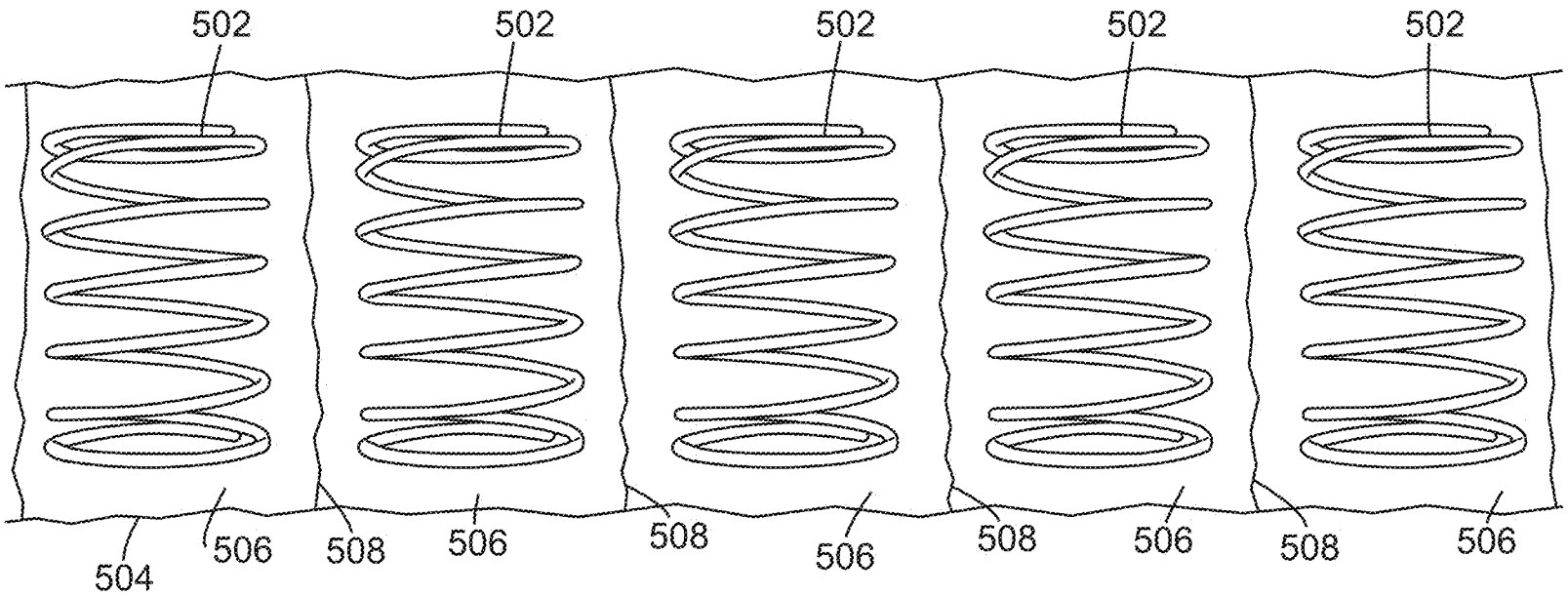
FIG. 5 is a representation of a partial microcoil cell with pocketed microcoils.

Referring to FIG. 4, in one embodiment, a given microcoil cell 400 contains the plurality of individual microcoils 402 disposed within a fabric covering 404 in a pocketed arrangement. Suitable fabric coverings for pocketing microcoils are known and available in the art. Referring to FIG. 5, a portion of a microcoil cell 500 in a pocketed arrangement is illustrated. Each microcoil is contained in a separate pocket 506 formed from the fabric covering 504. A piece of fabric 508 is disposed between or surrounds each microcoil in the microcoil cell. Therefore, the microcoils are separated and do not touch in any given configuration of the microcoil cell.

Figure 6:
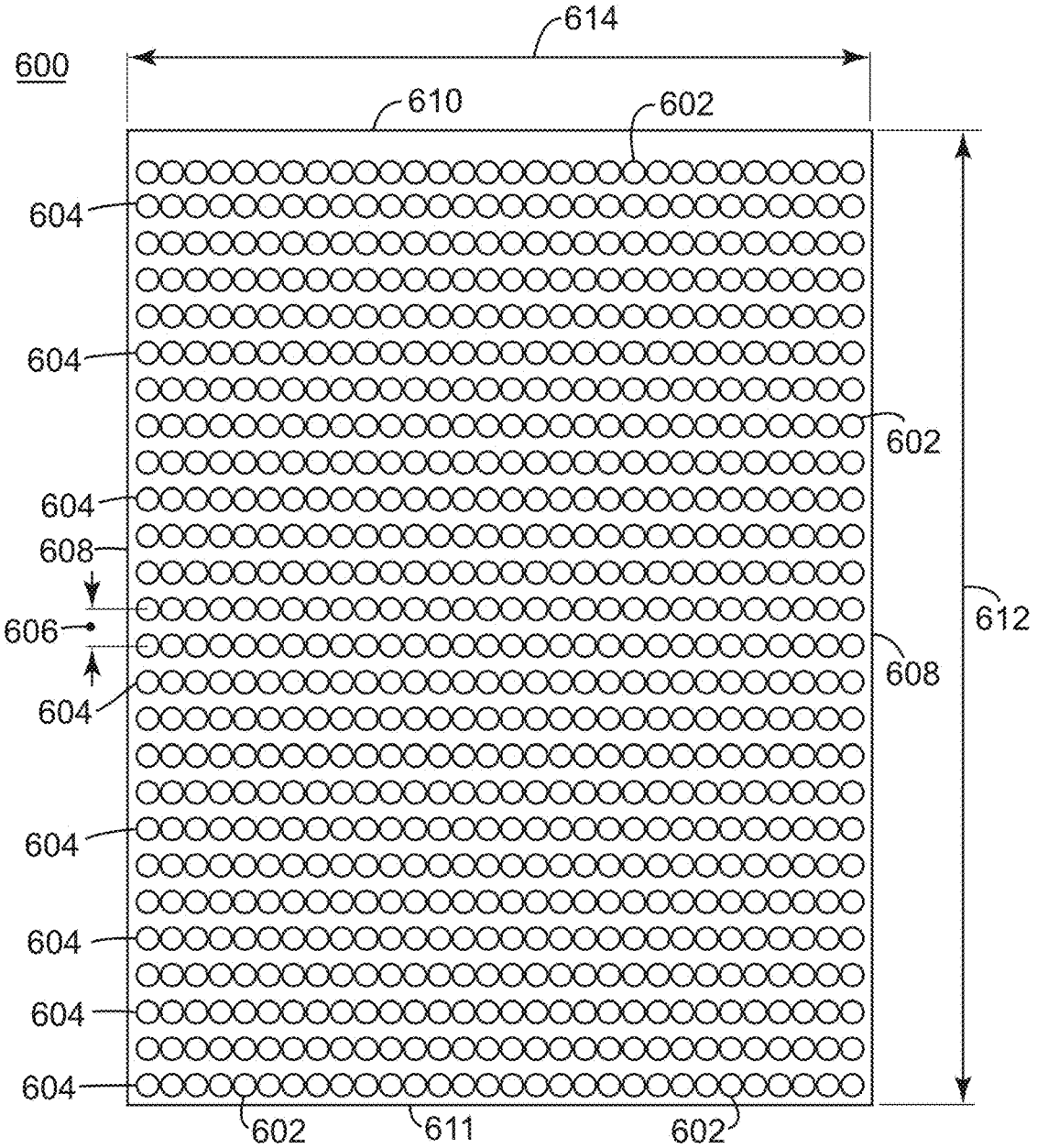
FIG. 6 is a plan representation of an embodiment of an arrangement of microcoil cells arranged as parallel lines within a mattress.

Referring to FIG. 6, an embodiment of a mattress 600 containing an arrangement of microcoil cells is illustrated. The mattress includes a top or head end 610 and a bottom or foot end 611 opposite the top end. The spacing between the two ends defines an overall length 612 of the mattress. Spanning this length are two opposite sides 608 of the mattress, defining an overall width 614 of the mattress. The individual microcoils 602 are arranged into a plurality of separate microcoil cells 604. Each microcoil cell is a line of microcoils having a width comprising a single microcoil and a length comprising a plurality of microcoils. In particular, the length of the line of microcoils in each microcoil cell contains a sufficient number of microcoils such that the line of microcoils spans the mattress width. The plurality of microcoil cells is arranged as a plurality of parallel lines of microcoils, i.e., the microcoils cells are arranged parallel to each other and parallel to the width of the mattress. The center to center spacing 606 between adjacent parallel lines of microcoils is greater than a diameter of each individual microcoil.

Figure 7:
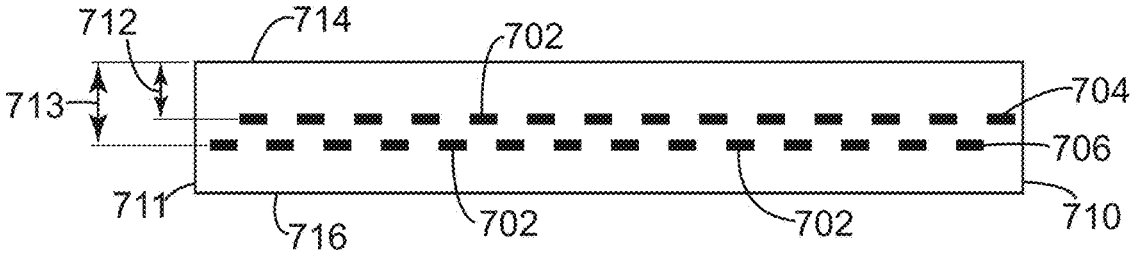
FIG. 7 is an elevational representation of an embodiment of an arrangement of microcoil cells arranged as parallel lines within a mattress.

Referring to FIG. 7, a cross-sectional representation of the mattress shows that the microcoils are disposed between the top face 714 and the bottom face 716 of the mattress, and each individual microcoil cell spans the width of the mattress and the parallel lines of microcoil cells are spaced from the top end 710 of the mattress to the bottom end 711 of the mattress. Each microcoil cell does not have to be located at the same distance from the top face and the bottom face. As illustrated, the microcoil cells include a first group of microcoil cells 704 and a second group of microcoil cells 706. Each group of microcoil cells includes at least one microcoil cell. Each microcoil cell in the first group of microcoil cells 704 is disposed a first distance 712 from the top face. Each microcoil cell in the second group of microcoil cells 706 is disposed a second distance 713 from the top face 714. The first distance is different than the second distance. Since the microcoil cells are arranged as parallel lines, the plurality of parallel lines of microcoils include a first group of parallel lines of microcoils, i.e., the first group of microcoil cells, disposed the first distance from the top face and a second group of parallel lines of microcoils, i.e., the second group of microcoil cells, disposed a second distance from the top face. This arrangement of microcoil cells covers substantially the entire width and length of the mattress without using a single, unitary layer of coils or microcoils.

While illustrated and described using microcoil cells that are arranged as parallel lines of microcoils and only two groups of microcoil cells spaced at two separate distances from the top face, other suitable configurations of microcoil cells can be used. In one embodiment, the plurality of microcoil cells includes a plurality of groups of microcoil cells, e.g., more than two groups of microcoils cells. Each group of microcoil cells includes at least one microcoil cell. Each microcoil cell in a given group of microcoil cells is disposed a unique distance from the top face. This unique distance is associated with that given group of microcoil cells. Therefore, microcoil cells can be located at various depths within the mattress. In addition, the microcoil cells in the various groups of microcoil cells can overlap as they are located at different depths. In addition, each microcoil cell can have a shape other than a line, e.g., a grid or other shape. A given microcoil cell can be spaced from each one of the ends and sides of the mattress and can extend along a portion of the width and length of the mattress.

Figure 8:
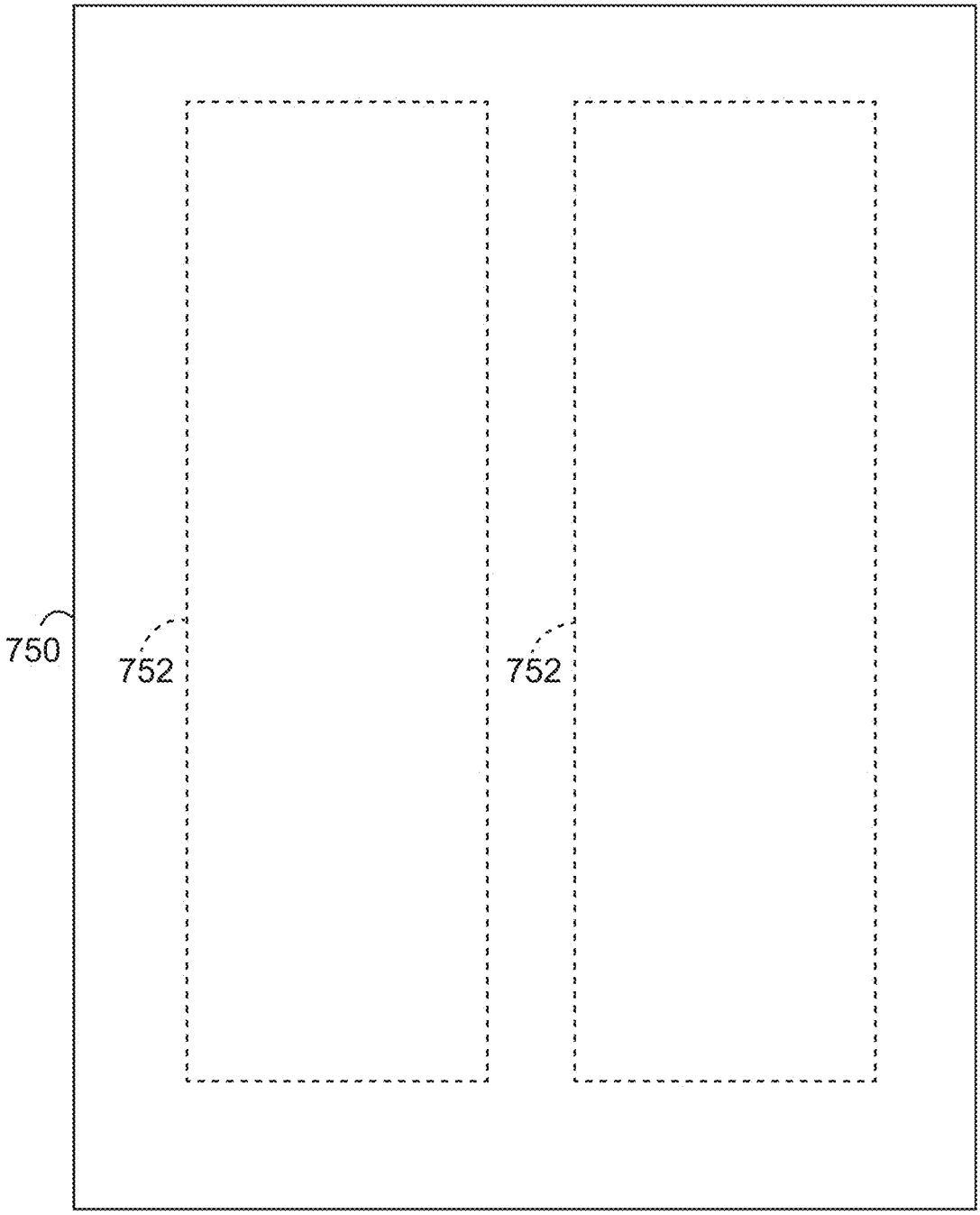
FIG. 8 is a plan representation of another embodiment of an arrangement of microcoil cells within a mattress.

Referring to FIG. 8, in one embodiment, two separate elongated rectangular microcoil cells 752 are provided in the mattress 750 and located to be under one of two users of the mattress. Each elongated cell can be a grid of microcoils located at a given depth within the mattress. Alternatively, each elongated cell can be constructed from a plurality of parallel lines of microcoil cells running along either the length or width of the mattress. The lines of microcoil cells can all be at the same depth within the mattress or at different depths depending on the location of that line along the length or width of the mattress. For example, microcoil cells at positions near the core or center of mass of the body can be located at deeper depths from the top face.

Figure 9:
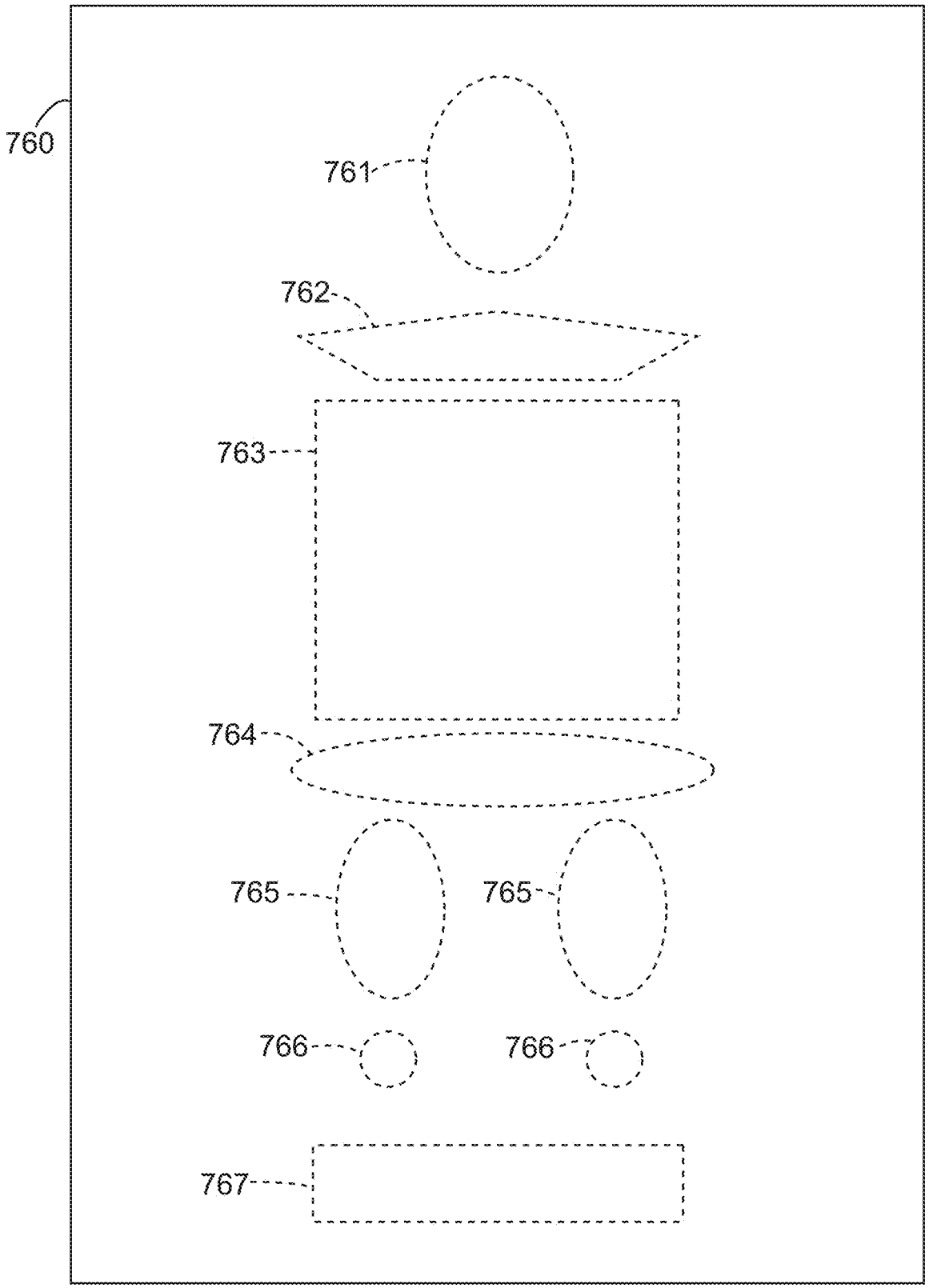
FIG. 9 is a plan representation of another embodiment of an arrangement of microcoil cells within a mattress.

Referring to FIG. 9, in one embodiment, the mattress 760 includes a plurality of smaller microcoils cells that vary in size, number of microcoils and shape. These smaller microcoil cells can be located at one or more of the head 761, shoulders 762, torso 763, hips 764, thighs 765, knees 766 and feet 767 of each user of the mattress. These various microcoil cells can be located at different depths within the mattress depending on the relative size, shape and weight of the associated body portion.

Figure 10:
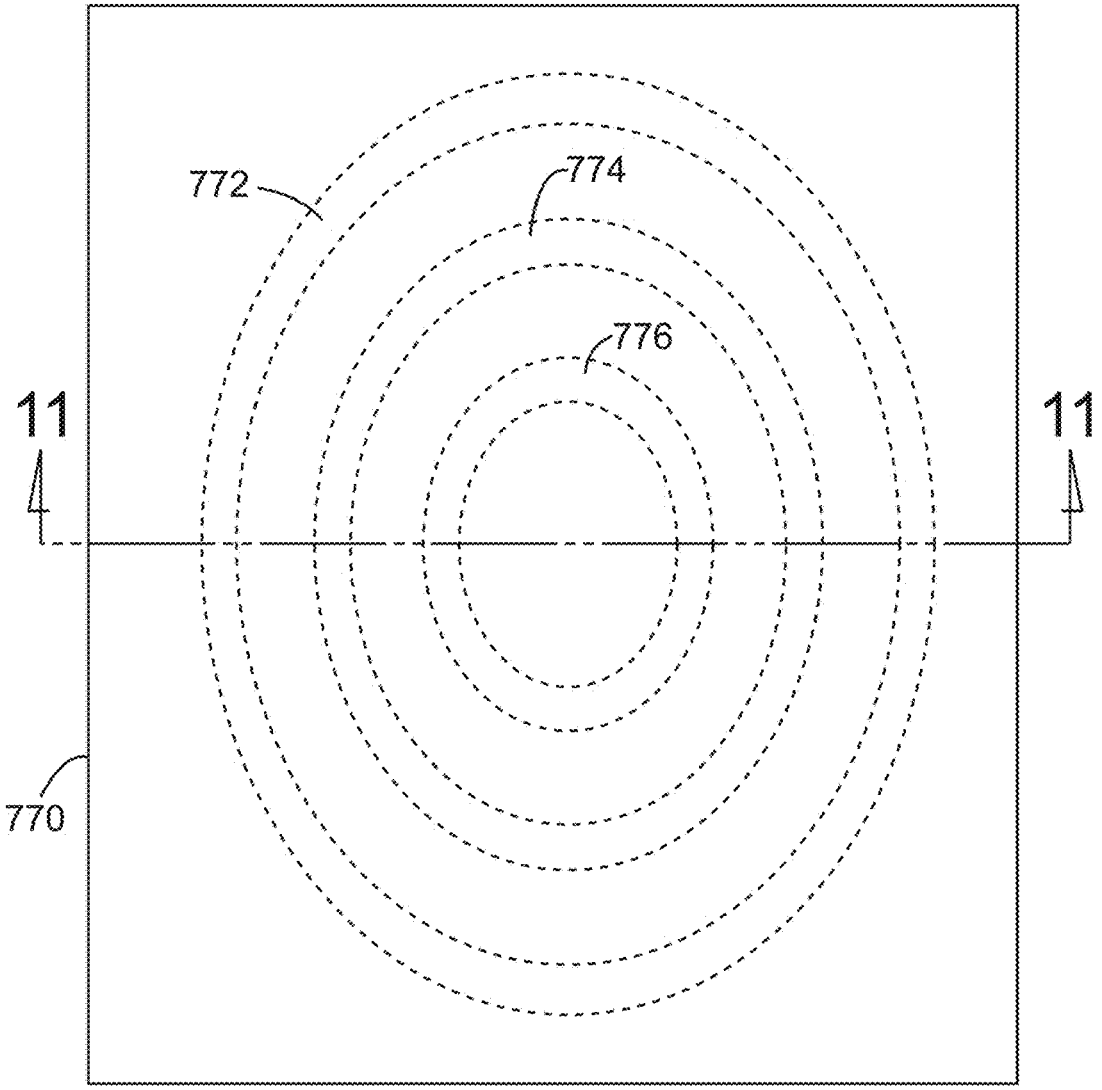
FIG. 10 is a plan representation of another embodiment of an arrangement of microcoil cells within a mattress.
Figure 11:
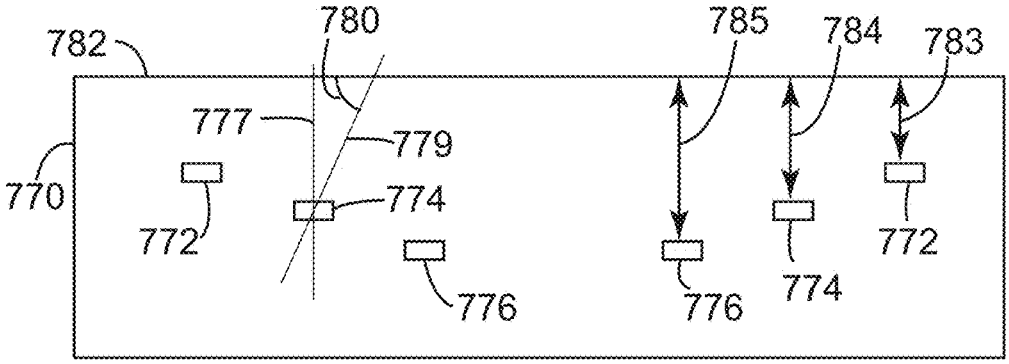
FIG. 11 is a cutaway view of the embodiment of FIG. 10 through line 11-11.

Referring to FIGS. 10 and 11, in one embodiment the microcoil cells are arranged as concentric rings 772, 774, 776 of circular or rectangular cells within the mattress 770. These can be rings of single lines of microcoils or multiple microcoil line segments. Each microcoil cell or each ring is located at a different distance 783, 784, 785 below the top face 782. This distance increases from the outer rings to the inner rings. Therefore, the microcoil cells form a cupped shape within the mattress to further conform to the shape of the body. The central axis 777 of any given microcoil within the plurality of microcoil cells can be aligned perpendicular to the top face. Alternatively, one or more microcoils can have a tilted central axis 779 that intersects the top face at an angle 780 other than 90°. These microcoils with tilted axes further enhance the cupped shaped and conforming qualities of the microcoil cells.

Figure 12:
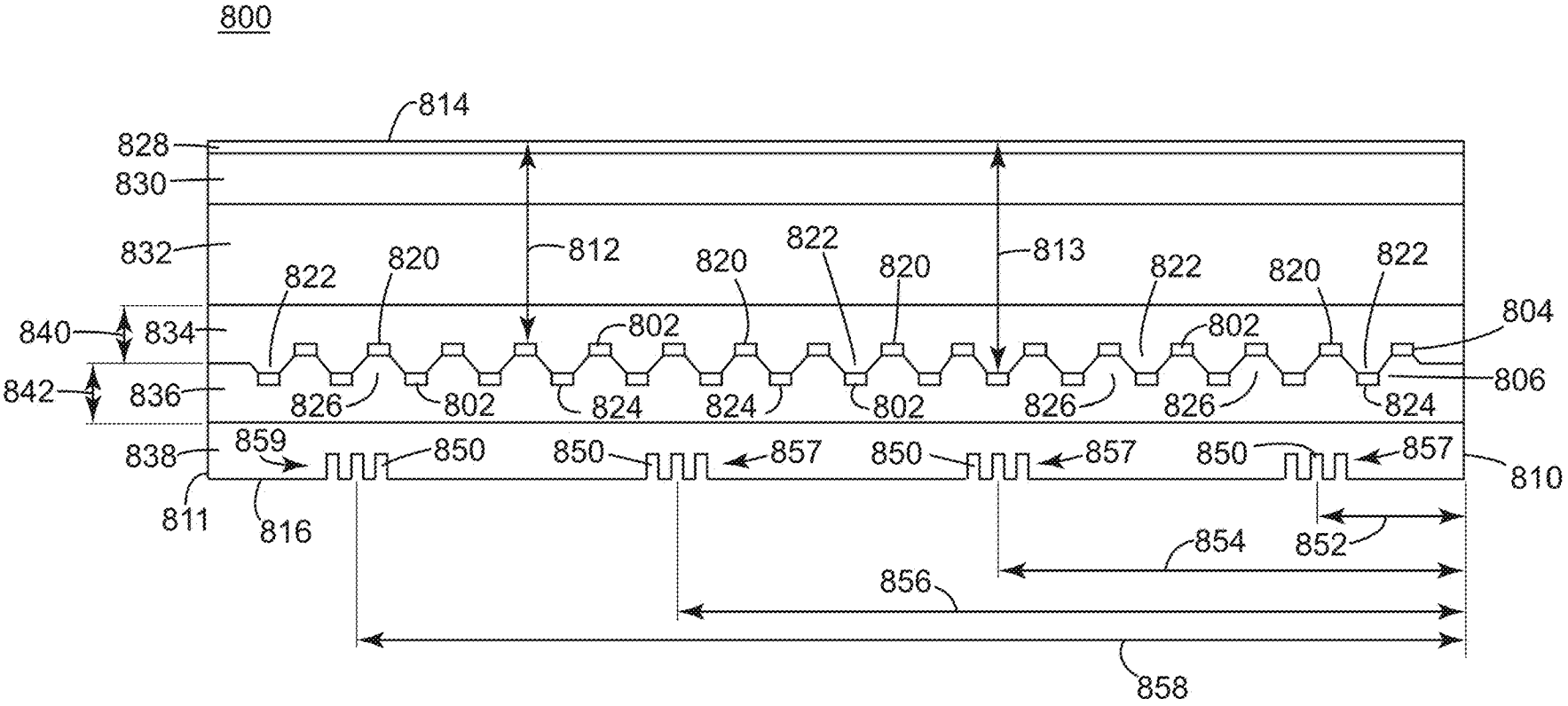
FIG. 12 is an elevational cutaway view along a length of an embodiment of a mattress containing microcoil cells.

Referring to FIG. 12, a cross-sectional representation along the length of another embodiment of mattress 800 is provided. The mattress includes the plurality of microcoils 802 disposed between the top face 814 and the bottom face 816 of the mattress. The microcoils are arranged in the plurality of parallel lines of microcoil cells that span the width of the mattress and extend from the top end 810 of the mattress to the bottom end 811 of the mattress. The microcoil cells are arranged into a first group 804 of microcoil cells spaced a first distance 812 from the top face, and a second group 806 of microcoil cells space a second distance 813 from the top face. The first distance is different, e.g., less, than the second distance.

The mattress 800 includes multiple layers between the top face and the bottom face. A first layer 828 at the top face is a fabric layer than can be flat or quilted. Suitable fabric layers include, but are not limited to, knit fabrics such as Coolmax® 3D Circular Knit Fabric, commercially available from Invista of Wichita, Kans. Other suitable fabrics for face layers of mattresses that are known and available in the art can also be used. A second layer 830 is provided in contact with the first layer opposite the top face. Suitable second layers include, but are not limited to, foam layers such as memory foam layers. In one embodiment, the memory foam layer is a ventilated, gel-infused, cool-touch memory foam. Suitable thicknesses for the second layer include a thickness of up to about 1 inch (2.54 cm). A third layer 832 is provided in contact with the second layer opposite the first layer. Suitable materials for the third layer include, but are not limited to, a medium density foam. In one embodiment, the medium density foam is a ventilated gel infused medium density memory foam. Suitable thicknesses for the third layer include a thickness of up to about 2.5 inches (6.35 cm).

The mattress further includes a fourth layer 834 in contact with the third layer opposite the second layer. Suitable materials for the fourth layer include a firm foam such as a bodyshape poly foam. Suitable thicknesses 840 for the fourth layer include a thickness of up to about 2 inches (5.1 cm). A fifth layer 836 is provided in contact with the fourth layer opposite the third layer. Suitable materials for the fifth layer include a firm foam such as a bodyshape poly foam. Suitable thicknesses 842 for the fifth layer include a thickness of up to about 2 inches (5.1 cm).

The first group of microcoil cells 804 and the second group of microcoil cells 806 are disposed between the fourth and fifth layers of the mattress. When additional groups of microcoil cells are included, these groups are also included between the fourth and fifth layers. Therefore, the fourth layer is a first microcoil support foam layer, and the fifth layer is a second microcoil support foam layer in contact with the first microcoil support foam layer. The first and second microcoil support foam layers are disposed between the top face and the bottom face of the mattress with the first microcoil support foam layer disposed between the second microcoil support foam layer and the top face. In order to facilitate the microcoil cells, the first microcoil support foam layer includes a plurality of first pockets 820 and a plurality of first protrusions 822, and the second microcoil support foam layer includes a plurality of second pockets 824 and a plurality of second protrusions 826. As illustrated, the pockets and protrusions have a pyramid or frusto-conical cross section. However, other shapes of pockets and protrusions can be used. The plurality of second protrusions extends into the plurality of first pockets, and the plurality of first protrusions extends into the plurality of second pockets. Each one of the plurality of microcoil cells is disposed between a given second protrusion and first pocket or a given first protrusion and second pocket. For example, each microcoil cell in the first group of microcoil cells is disposed between a given second protrusion and first pocket, and each microcoil cell in the second group of microcoil cells is disposed between a given first protrusion and second pocket. Therefore, the number, shape, size and location of the pockets and protrusions are used to define and establish the location and depth of each microcoil cell within the mattress.

As was discussed above, the mattress includes a pair of opposing sides defining a mattress width there between, and each microcoil cell is a line of microcoils having a single microcoil in the width and a plurality of microcoils in the length. The number of microcoils in the length is sufficient to span the width of the mattress. In order to accommodate the microcoil cells configured as lines of microcoils, each one of the first and second protrusions is a ridge that spans the mattress width, and each one of the first and second pockets comprises a trough that spans the mattress width.

Figure 13:
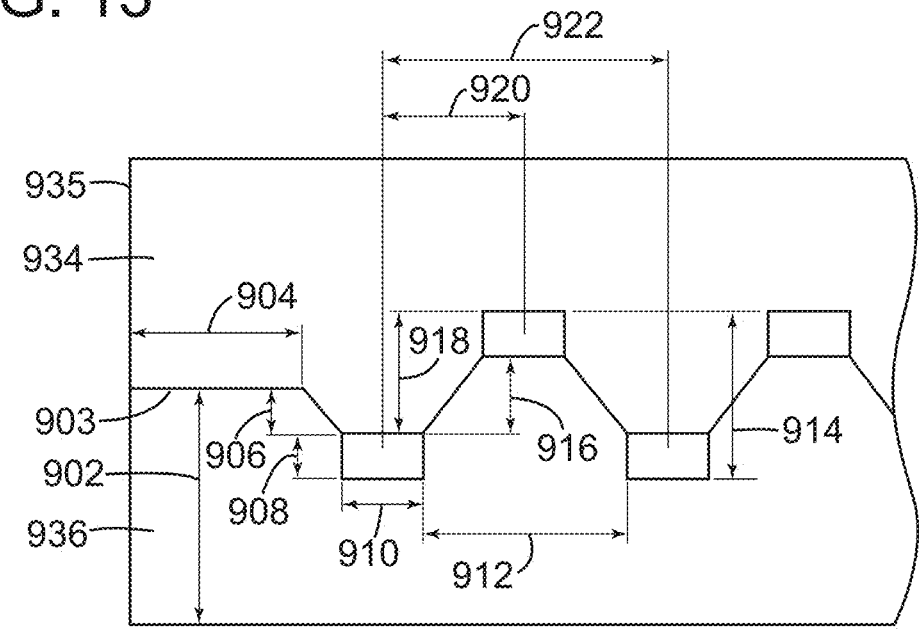
FIG. 13 is a partial view of the first and second microcoil support foam layers used in an embodiment of the mattress.

Referring to FIG. 13, an embodiment illustrating a portion of the first microcoil support foam layer 934 and the second microcoil support foam layer 936 is illustrated. As illustrated, the first and second microcoil support foam layers have a thickness 902 of about 3.7 inches (9.35 cm). The protrusions and pockets have an offset 904 from the end 935 of the mattress of about 2.9 inches (7.34 cm). Each microcoil cell is spaced down from the interface 903 between the two layers a distance 906 of about 0.6 inches (1.55 cm). Each coil and therefore each pocket extends down an additional distance 908 of about 0.71 inches (1.8 cm), i.e., the height of the microcoil. The coil portion of the pocket extends a length 910 of about 1.3 inches (3.3 cm), i.e., the diameter of the microcoil, and adjacent microcoils or pockets in a given layer are spaced apart by a distance 912 of about 3.25 inches (8.3 cm). The outer distance 914 between the pocket in one layer and a pocket in the other layer is about 2.7 inches (6.76 cm). The mircocoils cells in the first and second groups of microcoil cells are spaced apart along the thickness of the mattress by a distance 916 of about 1.22 inches (3.1 cm), and the total thickness 918 of each pocket is about 1.93 inches (4.9 cm). Adjacent microcoil cells in the first and second groups of microcoil cells have a center to center spacing 920 of about 2.25 inches (5.72 cm), and adjacent microcoil cells within either the first group of second group of microcoil cells have a center to center spacing 922 of about 4.5 inches (11.43 cm).

These dimensions are maintained along the entire length and width of the mattress. However, other embodiments are possible where one of more of these dimensions are modified. These modifications can result from a change in the size or thickness of one or more of the mattress, microcoil or microcoil cell. In addition, the number of rows of microcoil cells is varied depending on the length of the mattress. In one embodiment, the length of the mattress is about 80 inches (203.2 cm), and the total number of rows of lines of microcoils, i.e., microcoil cells, is 32, which can be arranged as 16 microcoil cells in the first group and 16 microcoil cells in the second group.

Returning to FIG. 12, the mattress 800 also includes a sixth layer 838 in contact with the fifth layer and disposed between the bottom face 816 and the fifth layer. In one embodiment, the sixth layer constitutes the bottom face. Suitable materials for the sixth layer include high density foam such as a high density flex-cut poly support base foam. Suitable thicknesses for the sixth layer include at least 2 inches (5.1 cm) or at least 4 inches (10.2 cm). In order to provide flexibility in the mattress and the high density foam sixth layer of the mattress, the sixth layer includes a plurality of flex-cuts 850 spaced along the length of the mattress. Preferably, these flex cuts are arranged in flex-cut groups containing a plurality of flex-cuts. In one embodiment, each flex-cut group includes three separate flex-cuts, i.e., a tri-cut. In one embodiment, a first flex-cut group 853 is located in the head area of the mattress, and the center of this flex-cut group is spaced a first distance 852 from the first or head end 810 of the mattress. In one embodiment, the first distance is about 9 inches (22.86 cm). A second flex-cut group 855 is located in the shoulder area of the mattress, and the center of this flex-cut groups is spaced a second distance 854 from the first or head end 810 of the mattress. In one embodiment, the second distance is about 27 inches (68.58 cm). A third flex-cut group 857 is located in the lumbar area of the mattress, and the center of this flex-cut group is spaced a third distance 856 from the first or head end 810 of the mattress. In one embodiment, the third distance is about 52 inches (132.1 cm). A fourth flex-cut group 859 is located in the thigh area of the mattress, and the center of this flex-cut group is spaced a fourth distance 858 from the first or head end 810 of the mattress. In one embodiment, the fourth distance is about 70 inches (177.8 cm). This leaves an additional 9 to 10 inches (22.86 to 25.4 cm) to the second or foot end of the mattress.

Figure 14:
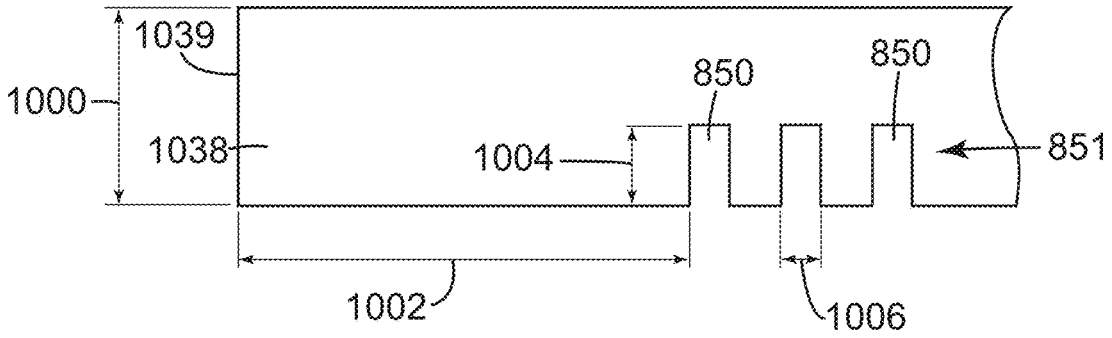
FIG. 14 is a partial view of an embodiment of the bottom layer of the mattress containing flex-cuts.

Referring to FIG. 14, in one embodiment the sixth layer 1038 having a thickness 1000 of about 3.5 inches (8.9 cm), a given flex-cut group 851 is illustrated having a plurality of flex cuts 850. As illustrated the flex cut group contains three flex-cuts, and the first flex-cut group is spaced from an end 1039 of the mattress by a distance 1002 of about 7.6 inches (19.35 cm). Each flex-cut extends into the sixth layer by a depth 1004 of about 1.5 inches (3.77 cm), and has a width 1006 along the length of the mattress of about 0.75 inches (1.91 cm). In one embodiment, each flex-cut extends an entire width of the mattress.

Figure 15:
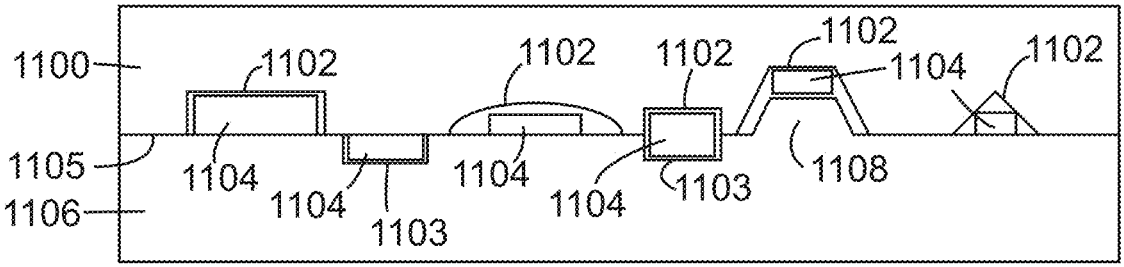
FIG. 15 is a representation of an embodiment of first and second foam layers of the mattress with pockets and protrusions for accommodating the microcoil cells.

Referring to FIG. 15, in general, the mattress includes at least one foam layer 1100 that is disposed between the top face and the bottom face and that includes a plurality of pockets 1102. Each one of the plurality of microcoil cells 1104 is disposed in one of the plurality of pockets. In general, each pocket is sized and shaped to accommodate a given microcoil cell and is located within the mattress to provide the desired positioning, depth and alignment for each given microcoil cell. The pockets can be identical or can vary and include rectangular, circular, conical and triangular cross-sections, among others. For example, the pockets are sized, shaped and aligned to accommodate any arrangement of microcoil cells described herein. In one embodiment, the pockets are set to depth such that the adjacent foam layer 1106 has a flat interface 1105 with the layer 1100 containing the plurality of pockets. Alternatively, the adjacent foam layer includes one or more protrusions 1108 extending into one or more of the pockets to hold the microcoil cells in place. This adjacent foam layer can also include pockets 1103, and the microcoil cells 1104 can be disposed between these pockets and the flat interface or between aligned pockets in the foam layer and the adjacent layer.

Figure 16:
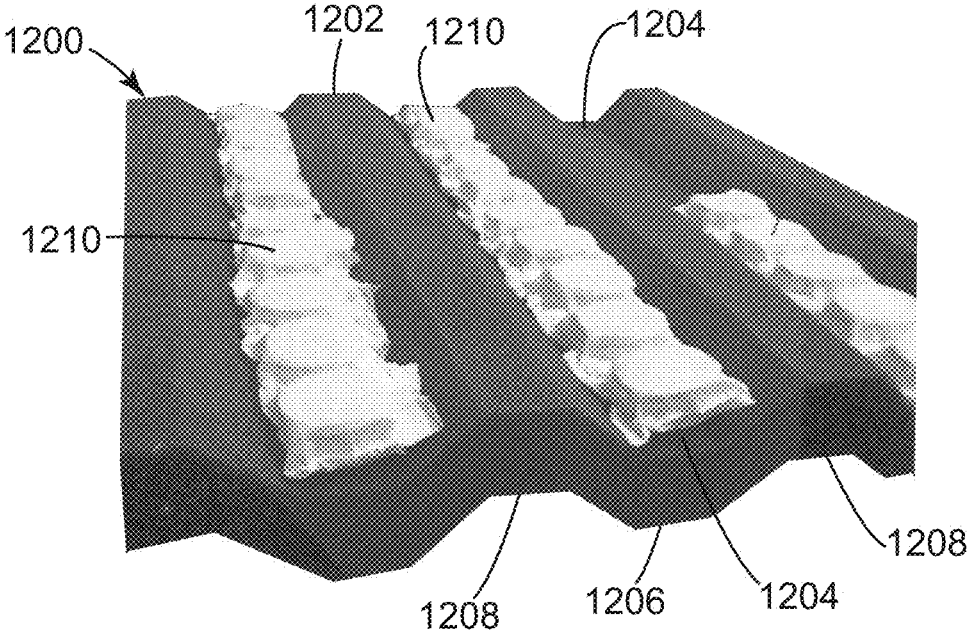
FIG. 16 is a partial perspective view of another embodiment of a foam layer containing pockets for the microcoil cells.
Figure 17:
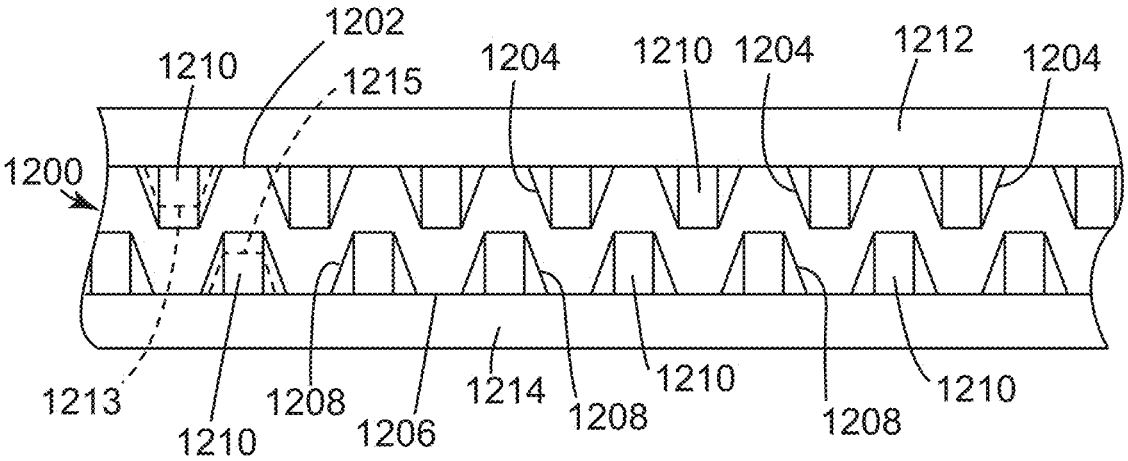
FIG. 17 is a partial elevation view of the foam layer of FIG. 16 in combination with covering and supporting foam layers.

Referring to FIGS. 16 and 17, a foam layer 1200 is provided in the mattress between the top face and the bottom face. The foam layer has a first side 1202 containing a plurality of first side pockets 1204 and a second side 1206 containing a plurality of second side pockets 1208. Each one of the plurality of microcoil cells 1210 is disposed in one of the plurality of first side pockets or the plurality of second side pockets. In one embodiment, each one of the first side pockets and the second side pockets is a trough that spans the mattress width. The troughs on the first and second sides are staggered, yielding a corrugated shape in the foam layer. These troughs span the width of the mattress, and when each microcoil cell is a line of microcoils, these microcoil cells are disposed in the troughs and span the width of the mattress. In one embodiment, a covering foam layer 1212 is provided in contact with the first side of the foam layer. The covering foam layer can be flat or can include a plurality of covering foam layer protrusions 1213 extending into the first side pockets. Similarly, the mattress includes a supporting foam layer 1214 in contact with the second side of the foam layer. The supporting foam layer can be flat or can include a plurality of support foam layer protrusions 1215 extending into the second side pockets. Suitable configurations of protrusions and pockets are similar to those illustrated herein with respect to other embodiments of foam layers containing pockets and protrusions. In one embodiment, each one of the plurality of microcoil cells is disposed between the plurality of first side pockets and the covering foam layer protrusions or the plurality of second side pockets and the supporting foam layer protrusions.

Figure 18:
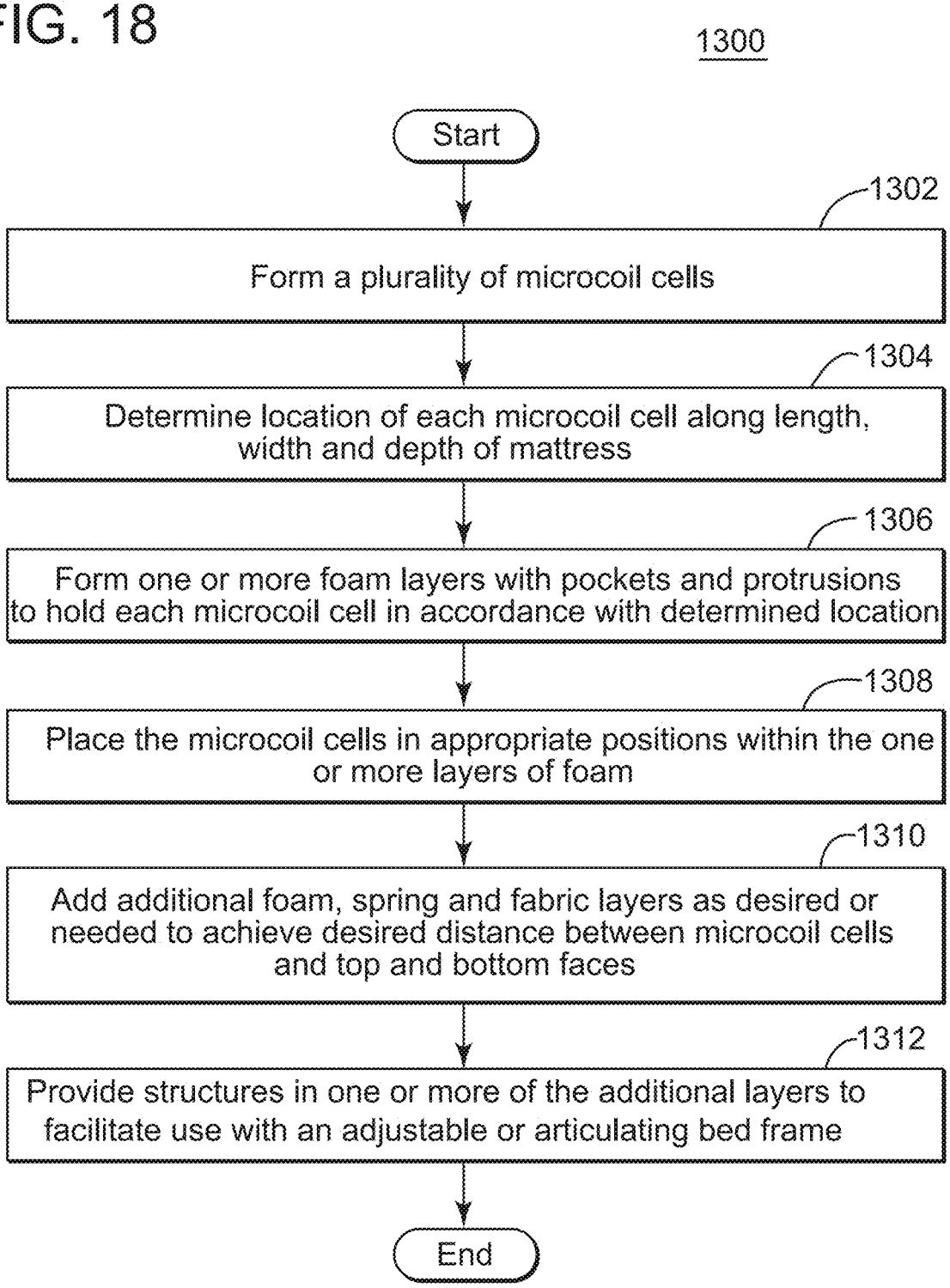
FIG. 18 is a flow chart illustrating an embodiment of a method for providing microcoil cells in a mattress.

Exemplary embodiments are also directed to methods for making and using embodiments of the mattresses containing the plurality of separate microcoil cells as disclosed herein. Referring to FIG. 18, an exemplary embodiment is directed to a method for providing increased comfort in a mattress using a plurality of separate and independent microcoil cells between the top face and bottom face of a mattress 1300. A plurality of microcoil cells is created or formed 1302. Each microcoil cell is formed by combining two or more contiguous microcoils in a line, grid or other desired shape. In one embodiment, the microcoils in each microcoil cell are formed as a plurality of pocketed microcoils. A determination is then made regarding the location of each microcoil cell with respect to a position along the length and width of the mattress and a distance from at least one of a top face and a bottom face of the mattress 1304.

One or more layers of foam are then formed or created having one or more of pockets and protrusions to accommodate each one of the plurality of microcoil cells in accordance with the determined locations 1306. The microcoil cells are then placed in the appropriate positions within the one or more layers of foam 1308. One or more additional layers of foam, springs or fabric are then added 1310 in contact with the layers of foam containing the microcoil cells. These additional layers are added to achieve the desired comfort and performance in the mattress and to achieve the desired distance between each microcoil cell and at least one of the top face and the bottom face of the mattress. Provide structures in at least one of the additional layers, e.g., flex-cuts in a bottom layer, to facilitate use of the mattress with an adjustable or articulating bed frame 1312.

The resulting mattress is then placed on a frame or an articulating foundation that provides for articulation of each end of the bed and possibly each side of the bed for at least one of the top section or the foot section of the mattress. In one embodiment the mattress is fixedly secured to the foundation. In addition, the method includes mounting the foundation on a fixed bed frame. The mattress is moved or articulated using the foundation in accordance the positioning preferences of each of user of the mattress. The microcoil cells are positioned within the mattress to improve the overall comfort of each user of the mattress.

Although the features and elements of the present exemplary embodiments are described in the embodiments in particular combinations, each feature or element can be used alone without the other features and elements of the embodiments or in various combinations with or without other features and elements disclosed herein. The methods or flowcharts provided in the present application may be implemented in a computer program, software, or firmware tangibly embodied in a computer-readable storage medium for execution by a dedicated computer or a processor.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A mattress comprising: a top face; a bottom face opposite the top face and spaced from the top face by a thickness of the mattress; and a plurality of microcoils arranged in a plurality of separate microcoil cells disposed between the top face and the bottom face, each microcoil cell comprising at least two contiguous microcoils and the plurality of microcoil cells comprising a first group of microcoil cells centered a first distance from the top face and a second group of microcoil cells centered a second distance from the top face, the first distance different than the second distance and the microcoils in the first group of microcoil cells spaced apart from and not overlapping with the microcoils in the second group of microcoil cells along the thickness of the mattress.

2. The mattress of claim 1, wherein each microcoil comprises a diameter of less than about 1.25 inches and a height of less than about 1 inch.

3. The mattress of claim 1, wherein the the microcoils in the first group of microcoil cells and the microcoils in the second group of microcoil cells are spaced apart along the thickness by a separation distance of about 1.22 inches.

4. The mattress of claim 1, wherein the plurality of microcoil cells further comprises a plurality of groups of microcoil cells, each group of microcoil cells comprising at least one microcoil cell and each microcoil cell in a given group of microcoil cells disposed a unique distance from the top face that is associated with that given group of microcoil cells.

5. The mattress of claim 1, wherein each microcoil cell comprises a line of microcoils having a width comprising a single microcoil and a length comprising a plurality of microcoils.

6. The mattress of claim 5, wherein:

the mattress further comprises a pair of opposing sides defining a mattress width there between; and the length of the line of microcoils comprises a sufficient number of microcoils such that the line of microcoils spans the mattress width.

7. The mattress of claim 5, wherein:

the plurality of microcoil cells comprise a plurality of parallel lines of microcoils; and the mattress further comprises a center to center spacing between adjacent parallel lines of microcoils that is greater than a diameter of each microcoil.

8. The mattress of claim 7, wherein the plurality of parallel lines of microcoils comprises:

a first group of parallel lines of microcoils, all microcoils in each parallel line of microcoils in the first group of parallel lines of microcoils centered a first distance from the top face; and a second group of parallel lines of microcoils, all microcoils in each parallel line of microcoils in the second group of parallel lines of microcoils centered a second distance from the top face, the first distance different than the second distance.

9. The mattress of claim 8, wherein each microcoil cell comprises a grid of microcoils having at least two microcoils along a width of the grid and at least two microcoils along a length of the grid.

10. The mattress of claim 8, further comprising a foam layer disposed between the top face and the bottom face, the foam layer comprising a plurality of pockets, each one of the plurality of microcoil cells disposed in one of the plurality of pockets.

11. The mattress of claim 8, wherein:

the mattress further comprises a first microcoil support foam layer and a second microcoil support foam layer in contact with the first microcoil support foam layer, the first and second foam layers disposed between the top face and the bottom face;

the first microcoil support foam layer comprises a plurality of first pockets and a plurality of first protrusions; and the second microcoil support foam layer comprises a plurality of second pockets and a plurality of second protrusions;

wherein the plurality of second protrusions extend into the plurality of first pockets, the plurality of first protrusions extend into the plurality of second pockets and each one of the plurality of microcoil cells is disposed between a given second protrusion and first pocket or a given first protrusion and second pocket.

12. The mattress of claim 11, wherein:

the mattress further comprises a pair of opposing sides defining a mattress width there between;

each one of the first and second protrusions comprises a ridge that spans the mattress width;

each one of the first and second pockets comprises a trough that spans the mattress width; and each microcoil cell comprises a line of microcoils having a width comprising a single microcoil and a length comprising a plurality of microcoils.

13. The mattress of claim 8, wherein the mattress further comprises a foam layer disposed between the top face and the bottom face, the foam layer comprising:

a first side comprising a plurality of first side pockets; and a second side comprising a plurality of second side pockets;

wherein each one of the plurality of microcoil cells disposed in one of the plurality of first side pockets or the plurality of second side pockets.

14. The mattress of claim 13, wherein:

the mattress further comprises a pair of opposing sides defining a mattress width there between;

each one of the first side pockets and the second side pockets comprises a trough that spans the mattress width; and the foam layer comprises a corrugated shape.

15. The mattress of claim 14, each microcoil cell comprises a line of microcoils having a width comprising a single microcoil and a length comprising a plurality of microcoils.

16. The mattress of claim 13, further comprising:

a covering foam layer in contact with a first side of the foam layer, the covering foam layer comprising a plurality of covering foam layer protrusions extending into the first side pockets; and a supporting foam layer in contact with a second side of the foam layer, the supporting foam layer comprising a plurality of support foam layer protrusions extending into the second side pockets;

wherein each one of the plurality of microcoil cells is disposed between the plurality of first side pockets and the covering foam layer protrusions or the plurality of second side pockets and the supporting foam layer protrusions.

17. A mattress comprising:

a top face;

a bottom face opposite the top face;

a pair of opposing sides defining a mattress width there between;

a first microcoil support foam layer;

a second microcoil support foam layer in contact with the first foam layer, the first and second microcoil support foam layers disposed between the top face and the bottom face, wherein the first microcoil support foam layer comprises a plurality of first pockets and a plurality of first protrusions, the second microcoil support foam layer comprises a plurality of second pockets and a plurality of second protrusions, the plurality of second protrusions extend into the plurality of first pockets, the plurality of first protrusions extend into the plurality of second pockets, each one of the first and second protrusions comprises a ridge that spans the mattress width and each one of the first and second pockets comprises a trough that spans the mattress width; and a plurality of separate microcoil cells, each microcoil cell comprising a line of microcoils having a width comprising a single microcoil and a length comprising a sufficient number of microcoils such that the line of microcoils spans the mattress width, the plurality of microcoil cells comprising a first group of microcoil cells disposed between a given second protrusion and first pocket and a second group of microcoil cells disposed between a given first protrusion and second pocket, the first group of microcoil cells spaced from the second group of microcoil cells along a thickness between the top face and the bottom face.

18. A mattress comprising:

a top face;

a bottom face opposite the top face;

a pair of opposing sides defining a mattress width there between;

a foam layer disposed between the top face and the bottom face, the foam layer comprising:

a first side comprising a plurality of first side pockets; and a second side comprising a plurality of second side pockets, each one of the first side pockets and the second side pockets comprising a trough that spans the mattress width; and a plurality of separate microcoil cells, each microcoil cell comprising a line of microcoils having a width comprising a single microcoil and a length comprising a sufficient number of microcoils such that the line of microcoils spans the mattress width and each one of the plurality of microcoil cells disposed in one of the plurality of first side pockets or the plurality of second side pockets.

19. The mattress of claim 18, wherein the foam layer comprises a corrugated shape.

20. A mattress comprising:

a top face;

a bottom face opposite the top face;

a plurality of microcoils centered at two distinct distances from the top face and arranged in a plurality of separate microcoil cells disposed between the top face and the bottom face, each microcoil cell comprising at least two contiguous microcoils and all microcoils in each microcoil cell centered at one of two distances from the top face; and a foam layer disposed between the top face and the bottom face, the foam layer comprising a plurality of pockets, each one of the plurality of microcoil cells disposed in one of the plurality of pockets.

* * * * *